US005080581A

United States Patent [19]

Walker

[11] Patent Number: 5,080,581

[45] Date of Patent: Jan. 14, 1992

[54] METHOD AND APPARATUS FOR DRYING WASTE MATERIALS

[75] Inventor: David R. Walker, Clearwater, Fla.

[73] Assignee: Combustion Design Corporation, Tampa, Fla.

[21] Appl. No.: 510,421

[22] Filed: Apr. 19, 1990

[51] Int. Cl.[5] ..... F27B 7/02

[52] U.S. Cl. ..... 432/105; 432/118

[58] Field of Search ..... 432/103, 105, 107, 106, 432/110, 118

[56] References Cited

U.S. PATENT DOCUMENTS

| | | | |
|---|---|---|---|
| 2,213,667 | 9/1940 | Dundas et al. | 110/14 |
| 2,810,968 | 10/1957 | Pitt | 34/109 |
| 3,716,002 | 2/1973 | Porter et al. | 110/14 |
| 4,004,876 | 1/1977 | Sylvest | 432/105 |
| 4,361,100 | 11/1982 | Hinger | 110/238 |
| 4,517,902 | 5/1985 | Christian | 110/190 |
| 4,574,711 | 3/1986 | Christian | 110/264 |
| 4,794,872 | 1/1989 | Henery | 110/346 |
| 4,859,177 | 8/1989 | Kreisberg et al. | 432/105 |
| 4,881,473 | 11/1989 | Skinner | 110/244 |
| 4,913,552 | 4/1990 | Bracegirdle | 432/105 |
| 4,926,764 | 5/1990 | van den broek | 110/221 |
| 4,954,995 | 9/1990 | Marconnet | 432/118 |
| 4,955,722 | 9/1990 | Marconnet | 432/118 |
| 4,957,429 | 9/1990 | Mendenhall | 432/105 |
| 4,957,433 | 9/1990 | Swisher, Jr. | 432/118 |
| 4,993,942 | 2/1991 | Boyden, II et al. | 432/105 |

*Primary Examiner*—Henry C. Yuen
*Attorney, Agent, or Firm*—Foley & Lardner

[57] ABSTRACT

A dryer assembly dries waste materials to a predetermined moisture level. The dryer includes a drum having an inlet where waste materials and hot gasses are simultaneously introduced, and an outlet where dried materials and hot vapors are transferred out of the dryer. The drum presents a plurality of preheat baffles in which the material is heated by but does not contact the gasses, thereby avoiding premature combustion of the material. Baffle sections located downstream of preheat baffles uniformly distribute material downstream into a primary drying section of the drum, where the material is mixed with the gasses to uniformly dry the material to the predetermined moisture level. The primary drying section includes alternating baffle sections which dry the material and which recycle material that is not yet dried back into the preceding baffle sections, respectively. The dryer can be readily adapted to accommodate a wide variety of materials of widely varying moisture levels by modifying the dwell times of the material within individual dryer sections and/or by varying the diameter of the dryer and the lengths of the individual dryer sections.

11 Claims, 18 Drawing Sheets

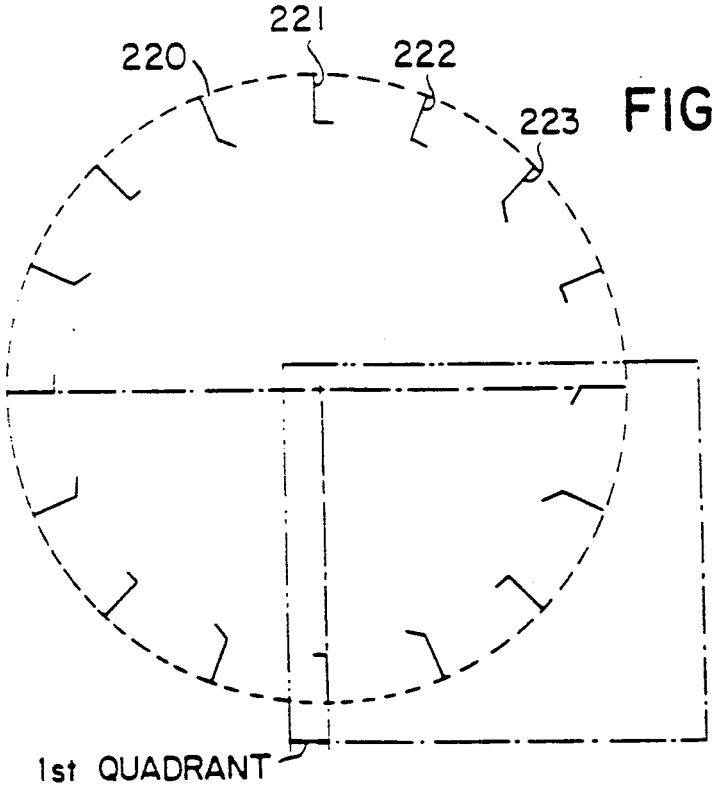
FIG. 10
FIG. 11
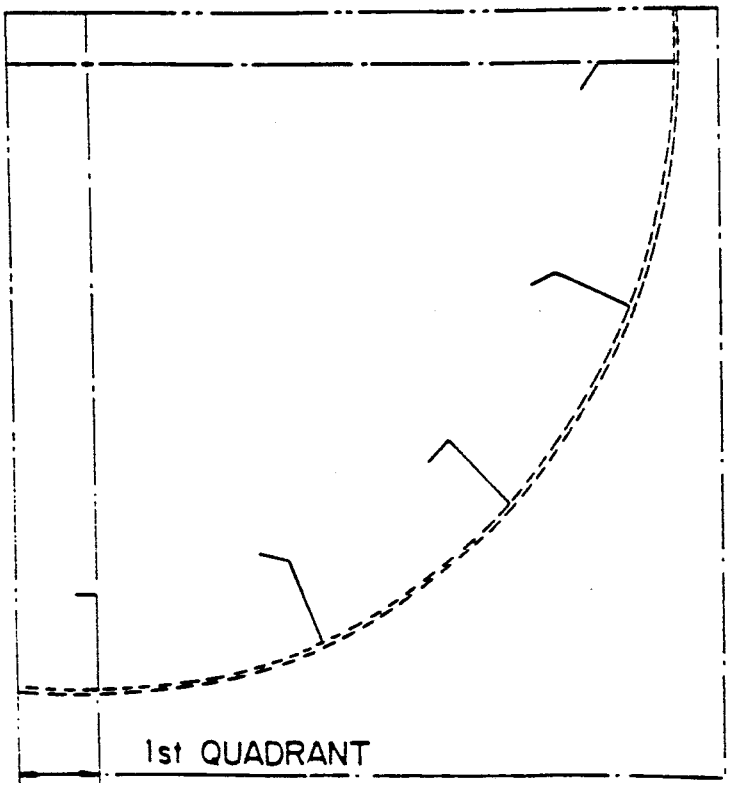

METHOD AND APPARATUS FOR DRYING WASTE MATERIALS

BACKGROUND OF THE INVENTION

The invention relates to a system for drying waste, mare particularly to a system for drying a wide range of sludge and other materials which vary in moisture content.

Environmental concerns have motivated a search for waste disposal systems capable of disposing of waste materials in accordance with the applicable regulating standards. The most widely used of these disposal means comprises incinerating the waste materials. It has ben discovered that incineration of such waste is most efficient if the material is preconditioned through drying before it is incinerated. However, conventional waste disposal systems incinerate waste without drying or with only minimal drying. Those systems that do dry waste materials typically include a dryer that removes a portion of the liquids from the waste materials. For example, U.S. Pat. No. 3,716,002 (Porter et al.) discloses a solid waste disposal system in which high-moisture content wastes are conveyed through a dryer where they are mixed with hot gasses before they are incinerated. But in order to avoid pre-mature combustion of the materials, the temperature of the gasses are not high enough to completely dry the wastes, requiring the recirculation of partially dried waste into the inlet of the dryer to premix with wet incoming waste such that the mixture has a reduced moisture content per unit weight of dryer throughput. This system thus is inefficient in that only a fraction of the material that is dried is actually passed on to the burner. Furthermore, there are no means in the dryer to ensure that the wastes are uniformly dried before they are conveyed to the burner.

Other conventional systems which dry waste materials are relatively inefficient and are incapable of accommodating a wide range of waste materials. To handle sludge materials having a high moisture content, for example, conventional systems must consume an excessive amount of fuel to uniformly dry high-moisture materials to a level necessary for complete combustion, resulting in an extremely inefficient drying operation. In addition, these systems are inflexible because they must be individually designed to dispose of a narrow range of waste materials. They are further limited in their treatment of a particular material, e.g. sludge, in that they burn prematurely (over-condition) materials of a relatively low moisture level and fail to adequately dry materials of a relatively high moisture level (under-conditioning).

SUMMARY OF THE INVENTION

It is therefore an object of the present invention to provide a dryer assembly which can be adapted easily to cleanly and efficiently dry a wide range of waste materials having wide ranges of moisture content, using a minimum amount of fossil fuels uniformly to dry.

It is a further object of the invention to provide a method for efficiently and uniformly drying a wide range of waste materials.

In achieving the stated objects, the present invention provides for a dryer assembly having an inlet portion, and outlet, and means for conveying materials from the inlet portion to the outlet. The conveying means includes pre-heating means, located within the inlet portion, which heats the materials within a space in which hot gasses are present but do not contact the material, such that combustion of the material is avoided while the temperature of the gasses is decreased. The conveying means further includes mixing means, located in a mixing portion situated between the preheating means and the outlet, which mixes the material with the gasses to dry the material uniformly to a predetermined moisture level.

In accordance with another aspect of the invention, the conveyor means comprises a drum type conveyor which presents a plurality of baffles. These baffles are adapted to mix the material while conveying it within the dryer.

In accordance with still another aspect of the invention, a plurality of the baffles are located within the inlet portion and are constructed with a cupping design which encloses the material and protects it from the hot gasses. Each of these baffles also includes external feed accelerators adapted to rapidly transfer a portion of the material into the mixing portion.

In accordance with another aspect of the invention, a plurality of the baffles in the mixing portion form alternating first and second baffle sections which define a primary drying section where the material is uniformly dried to the predetermined level. Each of the first baffle sections has a plurality of support bars extending radially inwardly form the perimeter of the drum and a plurality of polyhedral baffles mounted on each support bar. Each of the second baffle sections comprises a plurality of baffles having cupping members adapted to recycle within the primary drying section a part of the material that has not yet been dried to a predetermined moisture level.

According to still anther aspect of the invention, a method is provided for drying waste material which includes the steps of introducing hot gasses and a moisture laden material into the dryer which has a preconditioning and mixing portion, conveying the material through the preconditioning portion such that the material is heated by but does not contact the gasses, thereby avoiding premature combustion of the material, conveying the material through the mixing portion until it is uniformly mixed with the gasses and is dried to predetermined moisture level and conveying the material out of the outlet o the dryer.

According to yet another aspect of the invention, the method can include the step of adjusting the dimensions of the dryer to dry a wide variety of material having different moisture levels.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 10 is a sectional view taken along line c—c of FIG. 7.

FIG. 11 is an enlarged view of a portion of FIG. 10

DETAILED DESCRIPTION OF THE PREFERRED EMBODIMENTS

Pursuant to the present invention, waste materials are uniformly dried to a predetermined moisture level. This predetermined moisture level may be, for example, a level at which effective incineration can be performed. The dryer includes a drum having an inlet where waste materials and hot gasses are simultaneously introduced, and an outlet where dried materials and hot vapors are transferred out of the dryer. The drum presents a plurality of preheat baffles in which the material is heated by but does not contact the gasses, thereby avoiding premature combustion of the material. Baffle sections located downstream of the preheat baffles uniformly distribute material downstream into the primary drying section of the drum, where the material is mixed with the gasses to uniformly dry the material to the predetermined moisture level. The primary drying section includes alternating baffle sections which dry the material and which recycle material that is not yet dried back into the preceding baffle sections, respectively. The dryer can be readily adapted to accommodate a wide variety of materials of widely varying moisture levels by modifying the dwell times of the material within individual dryer sections and/or by varying the diameter of the dryer and the lengths of the individual dryer sections.

The dryer of the present invention is preferably used in conjunction with a system which conditions and incinerates waste materials of widely varying moisture contents. A detailed description of a preferred embodiment of the dryer assembly and of a system into which the dryer can be incorporated follows.

Figure 1A:
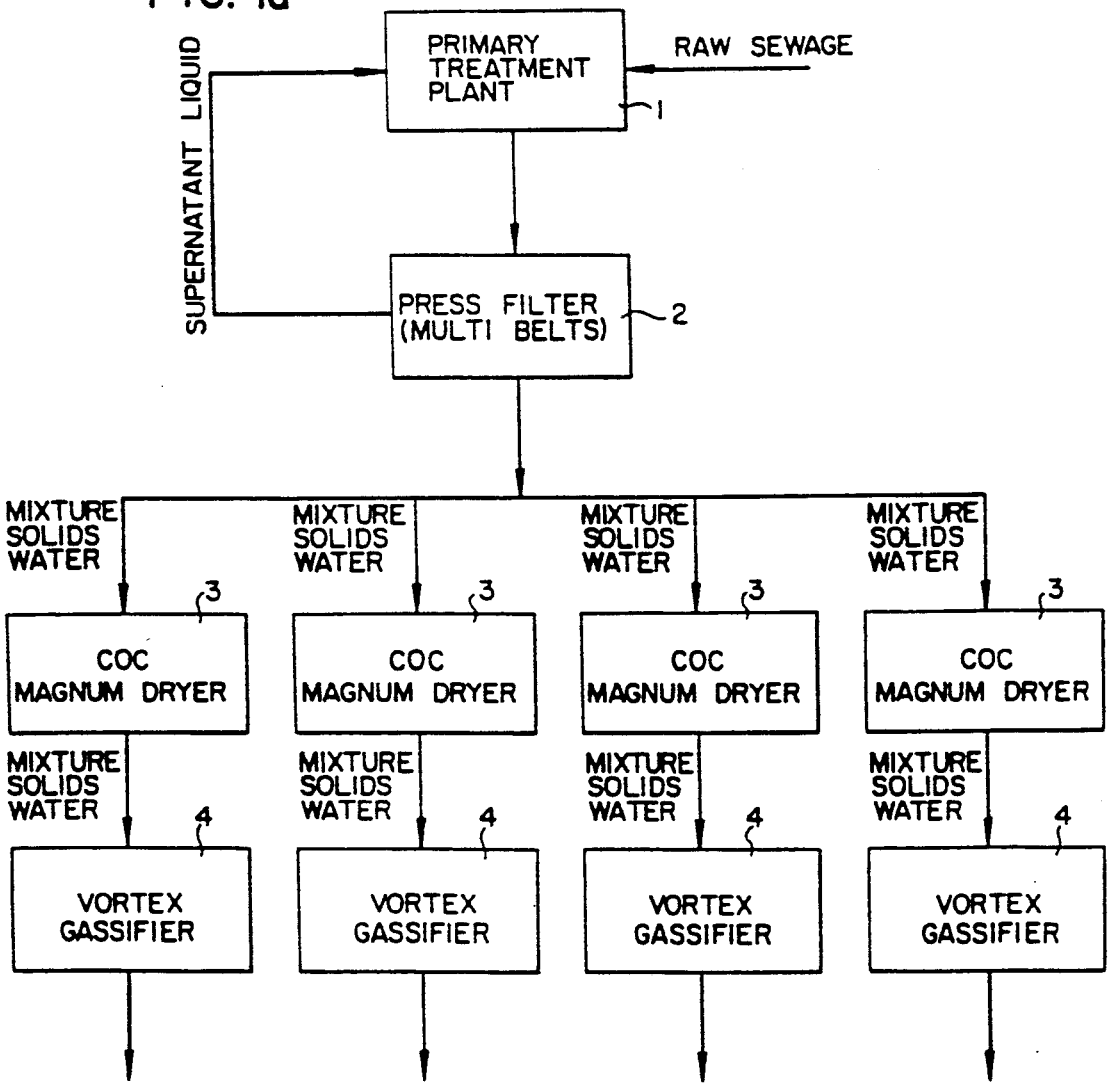
FIG. 1*a* is a flow chart depicting a waste disposal system in which drying according to the present invention is effected.
Figure 1B:
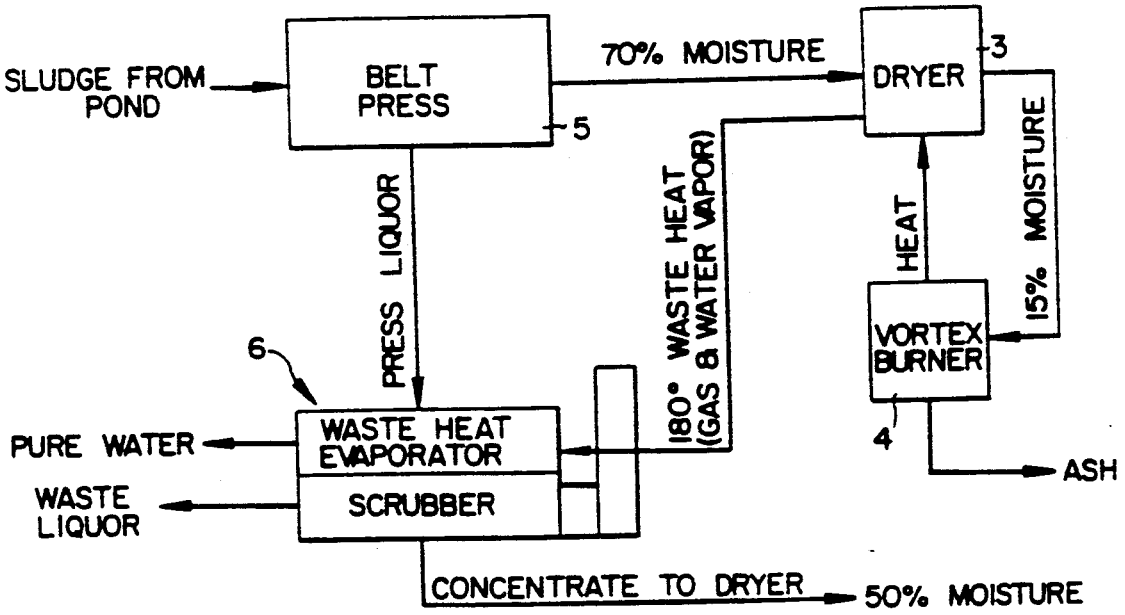
FIG. 1*b* is a flow chart depicting a belt press and waste heat evaporator used in conjunction with the present invention to prepare materials having an extremely high moisture content.
Figure 1C:
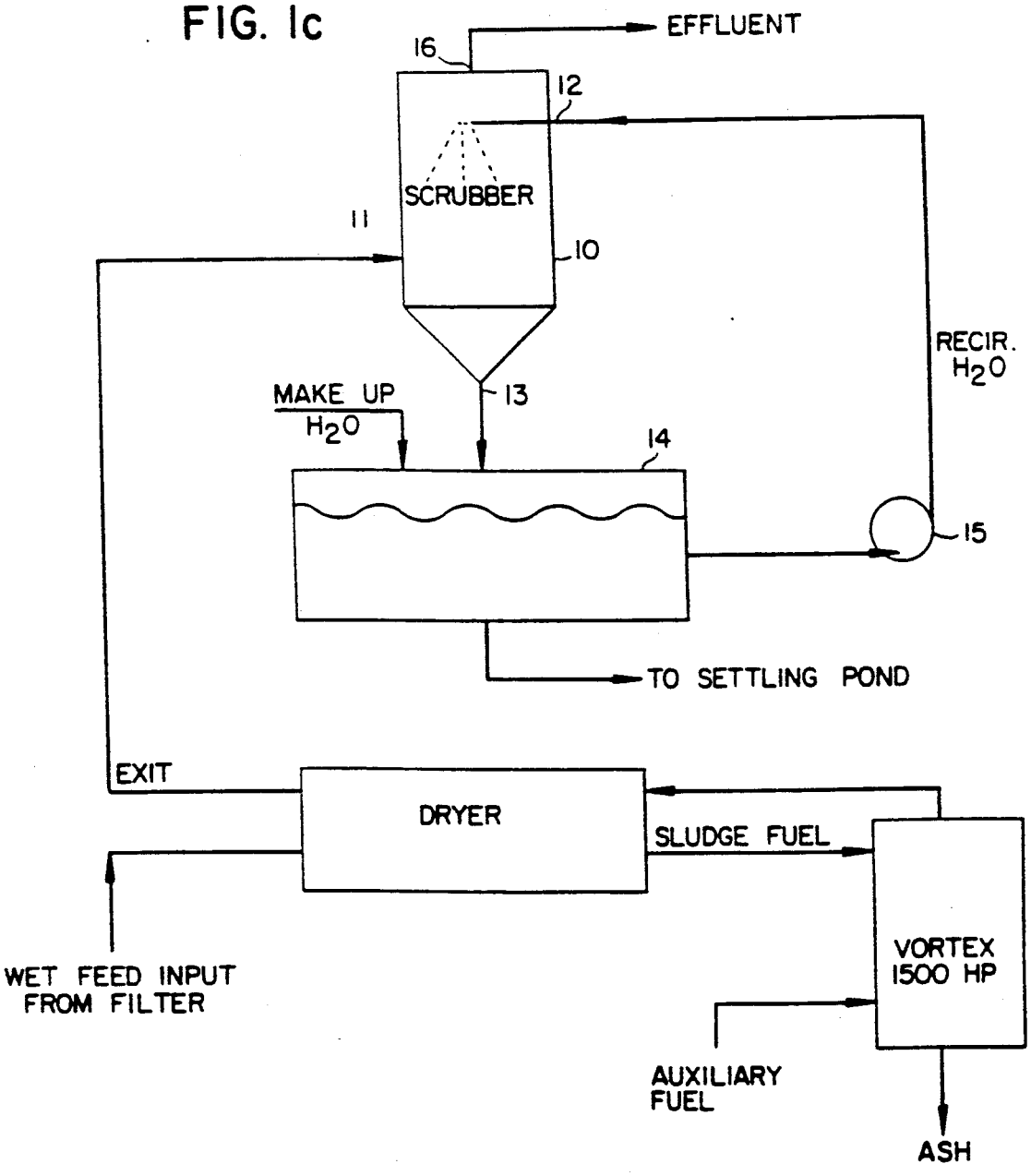
FIG. 1*c* is a flow chart depicting a scrubber system usable in connection with an embodiment of the present invention.

With regard to boxes 1 and 2 in FIG. 1*a*, the first step in the depicted process is to bring the material into the primary treatment plant and prepare (precondition) the waste material to ensure that it is at a suitable temperature and moisture level, and is free from excess particulate matter, before entering the drying process (box 3). This initial step can include, for example, running the waste material through a belt press-type filter 5, or any other type of mechanical dewatering device, and a scrubber 6 to remove and sterilize any supernatant liquid prior to conveying the waste material to the dryer.

Figure 1D:
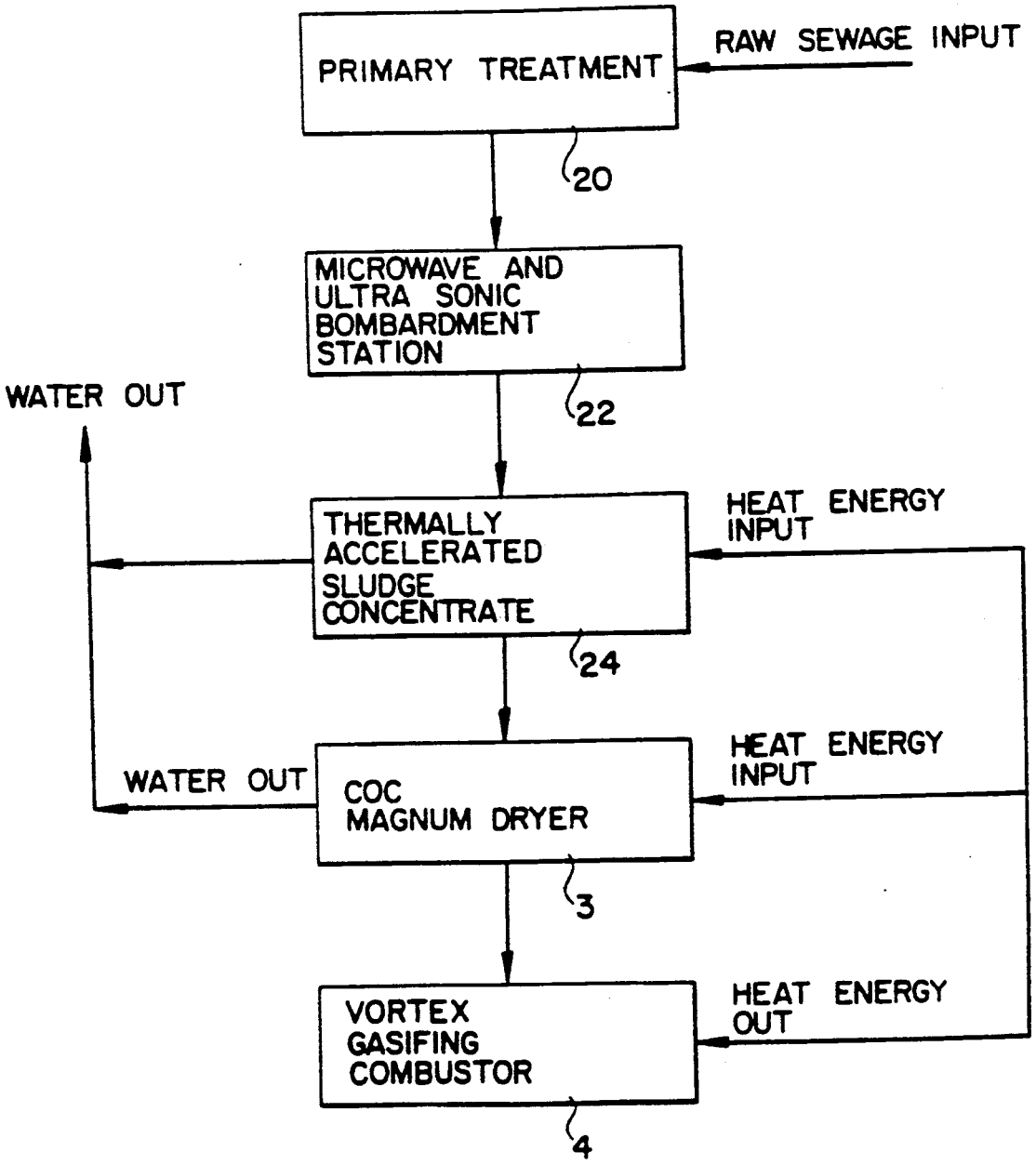
FIG. 1*d* is a flow chart depicting the waste disposal system that incorporates an embodiment of the present invention.

In the embodiment shown in FIG. 1*d*, boxes 20–24, waste materials that have a high metal content or otherwise require a higher combustion temperature undergo primary treatment such as microwave and ultra-sonic bombardment at station 22, such that the solid waste particles are pre-conditioned enabling the waste particles to liberate bound water when thermally activated thus improving the efficiency of the system in producing the desired end point moisture level.

Figure 5:
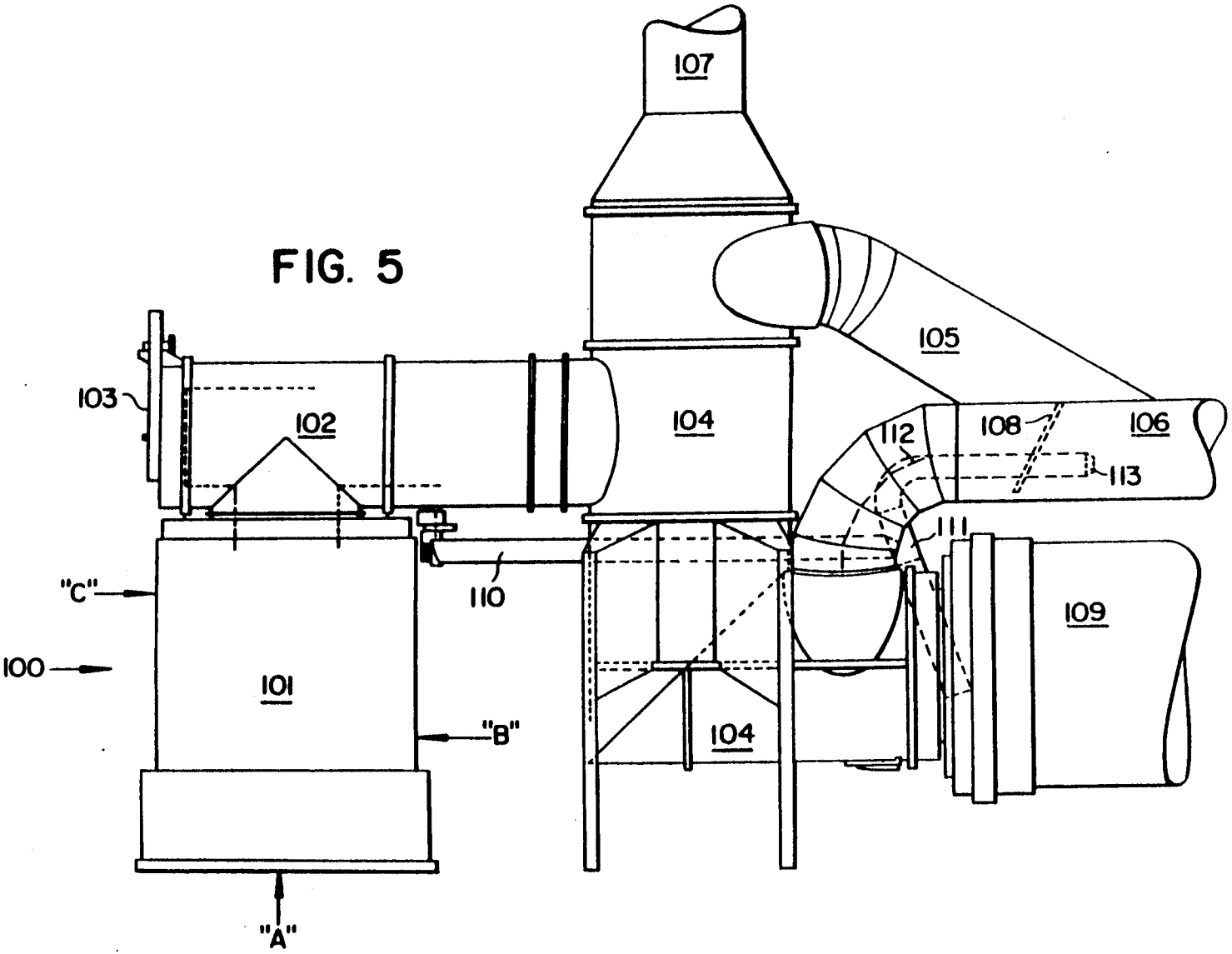
FIG. 5 is a front view of the burner in a preferred embodiment of the present invention.
Figure 6:
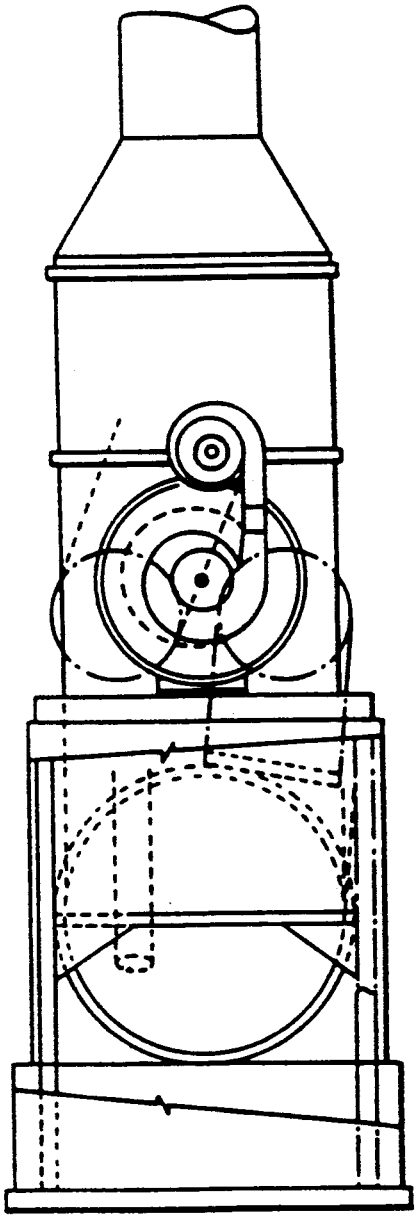
FIG. 6 is a sectional view of the burner of FIG. 5.

As shown in FIG. 5, after the waste material has been preconditioned in belt filter presses or other preconditioning stages, raw feed auger 110 receives the wet waste material from the belt filter presses and conveys it to dryer feed tube 111. Dryer feed tube 111 is connected to recycle tube 112 which attaches to the recycle conduit 106 at 113. Recycle gasses are thus pushpulled through feed tube 111, cleaning the internal surface of the feed tube and, thereby, avoiding particle buildup and eventual stoppage.

Figure 2:
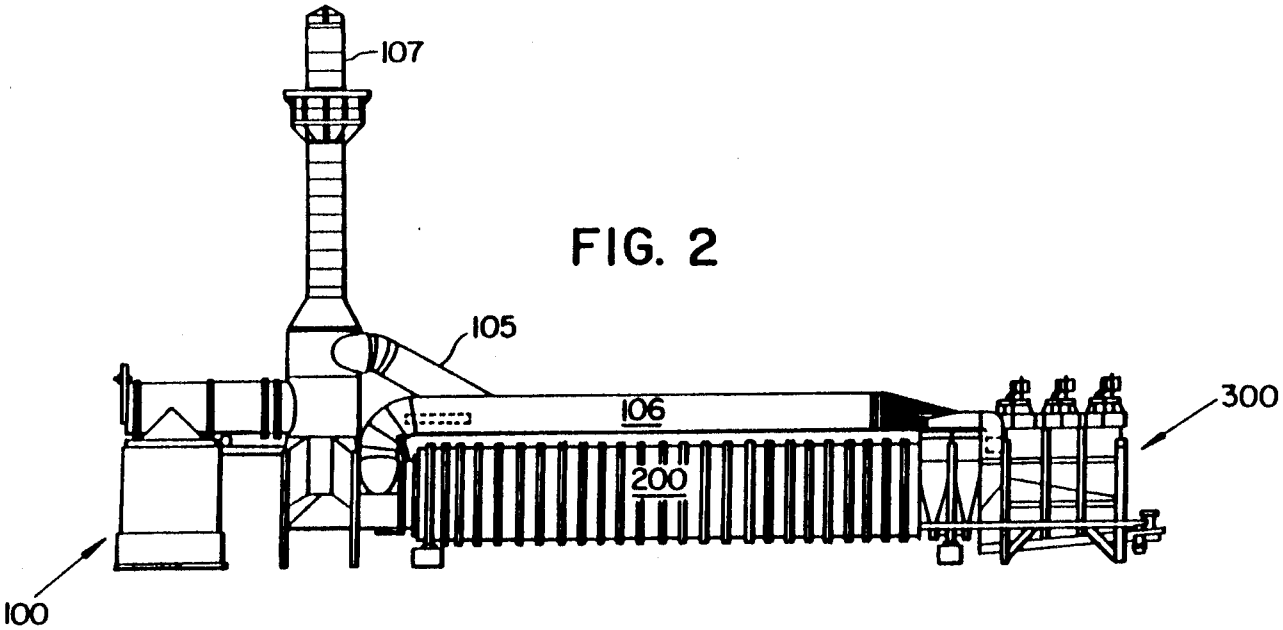
FIG. 2 is a side view of a waste disposal system including a preferred embodiment of the present invention.
Figure 3:
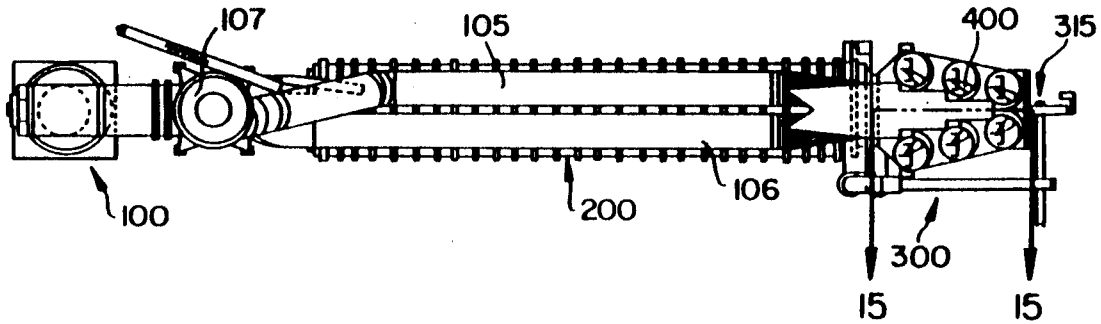
FIG. 3 is a top view of the waste disposal system.
Figure 4:
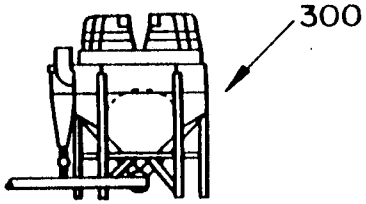
FIG. 4 is an end view of the waste disposal system.

As shown in FIGS. 2–4, preconditioned materials are conveyed into the primary conditioning system at the feed entry 109. The primary conditioning system includes a dryer assembly 200, a fan assembly 300 which removes vapors from the dryer outlet, and a burner 100 which gassifies in conjunction with incinerating the materials exiting dryer 200 and mixes hot exhaust gasses with vapors transported by fan assembly 300 to produce the hot gasses constituting the drying media for the dryer 200.

The burner is used to gassify and incinerate the waste material after it is uniformly dried. Thermal disposal of the waste in this manner also generates energy which can be used in part in drying the sludge during the preconditioning stage. As noted above, the exhaust gasses from the burner 100 are mixed with vapors recycled from the fan assembly 300 to produce a gas which is of a temperatures suitable for drying the material.

Many types of furnaces can accomplish the thermal disposal function. It is desirable to use a furnace that employs a type of burner that effects complete combustion of even high moisture content fuels by providing, as needed, both primary and secondary incineration. Exemplary of this type of burner is the so-called "vortex gassifier combuster" (VGC) described in U.S. Pat. No. 4,574,711 (J. Vernon Christian), the contents of which are hereby incorporated by reference. The control circuit for the VGC includes thermosensitive means which establish a set point temperature for the furnace, measures the flue gas and furnace temperature and controls the delivery of fuel and combustion air to the combustion chamber of the VGC to ensure that the set point temperature is maintained thereby ensuring efficient combustion which reduces pollution and prevents excess fuel consumption. The set point temperature can be adjusted depending on the type of waste material to be gassified and incinerated in the VGC. Exemplary of this type of control circuit is the so-called "stokermaster" control circuit described in U.S. Pat. No. 4,517,902 (J. Vernon Christian), the contents of which are hereby incorporated hereto by reference. This system takes into account the control parameters which affect efficient incineration of solid fuels, and calculates and maintains a set-point temperature at which the most efficient operation of a solid fuel burner is achieved.

In FIG. 5, component 100 is a VGC burner. After leaving the dryer, waste which has been dried to the predetermined moisture level enters the primary combustion chamber 101 of burner 100 at points A, B, or C or in any combination of these points. The hot flue gas (1600°-2300° F.) generated from the primary combustion of the waste material passes into a secondary combustion chamber 102 where the flue gas may be mixed, if further combustion is required, with flue gas generated from an auxiliary gas/oil burner 103. The heated flue gas then travels to a mixing chamber 104, where a two-step cooling process occurs. First, a combination of water vapor from the waste material and cooler vapor drawn from dryer exhaust conduit 105 mixes with hot flue gas from the VGC burner. The cooler vapor can have a temperature between 165°-275° F., for example, although a higher temperature may be appropriate, depending on the type of waste material. Mixing of the cooler vapor and hot flue gas forms gasses which enter a feed entry conduit of the dryer at a desirably reduced temperature range, for example, in a range of 600°-1400° F. Any excess flue gas which is not recycled to the mixing chamber is conveyed to discharge conduit 107 where oxidation of volatile materials takes place before the gas is discharged to the atmosphere.

Since the gasses are still too hot to come into direct contact with the waste material, recycle conduit 106 conveys the cooler recycled gasses from the fans to the feed entry conduit 109. The cooler recycled gasses then mix with the hot gasses from the mixing chamber to ensure that the gasses which enter the dryer 200 are at a lower temperature more suitable for drying the waste material. Recycle conduit 106 includes a damper 108 which limits the amount of cooler recycled gasses conveyed through recycle conduit 106, thereby ensuring that mixing chamber 104 is operating at less-than-atmospheric pressure, for example, around −0.25" W.C., thereby creating a partial vacuum. This negative pressure in mixing chamber 104 prevents hot gasses from escaping through conduit 107 to the atmosphere, thereby ensuring that the maximum amount of hot gasses are recycled, thus enhancing the overall efficiency of the VGC burner.

In addition, the control circuit of the VGC discussed earlier also contains thermosensitive circuits which control the temperature of the gasses recycled through the dryer. The thermosensitive circuits measure the temperature of the dryer exhaust vapor in conduits !06 and 107 and adjust the amount of fuel being incinerated by the VGC to control the moisture level of the vapor which ultimately controls the temperature of the flue gasses which mix with the cooler vapor for recycling through the dryer.

Figure 7:
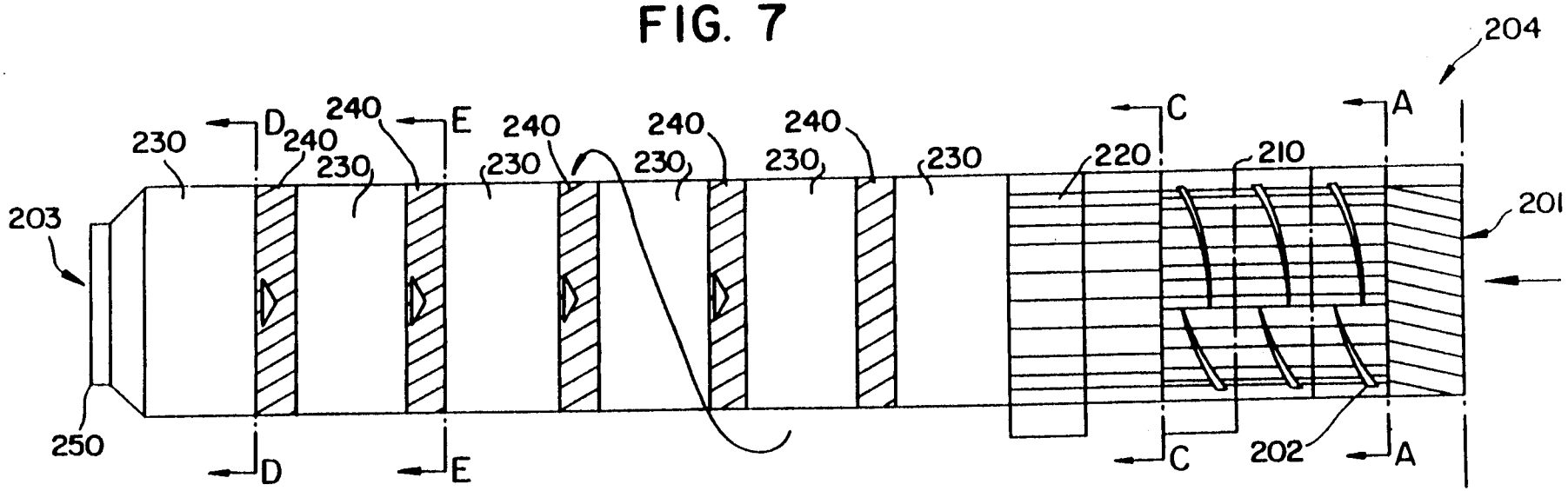
FIG. 7 is a partially schematic crosssectional side view of a preferred embodiment of the dryer assembly of the present invention.

With reference to FIG. 7, the high-moisture waste materials are conveyed through an inlet 201, of the dryer assembly 200 into a rotating dryer drum 202 where they are uniformly dried to a predetermined moisture level before leaving the dryer assembly at exit 203. The heat for drying the materials is supplied by the hot gasses which are produced by the furnace 100 and which also enter the dryer 200 at inlet 201. The dryer drum includes a feeder baffle section 204 which controls the feed rate of materials into the remaining dryer sections, a baffle section 210 in which the materials are preheated to achieve a more efficient drying operation, a distribution baffle section 220 which evenly distributes materials into the succeeding baffle sections, and a primary drying section comprising a plurality of heat transfer baffle sections 230 and recycle baffle sections 240. An outlet cone 250 is located at the outlet 203 of the dryer assembly.

Figure 8:
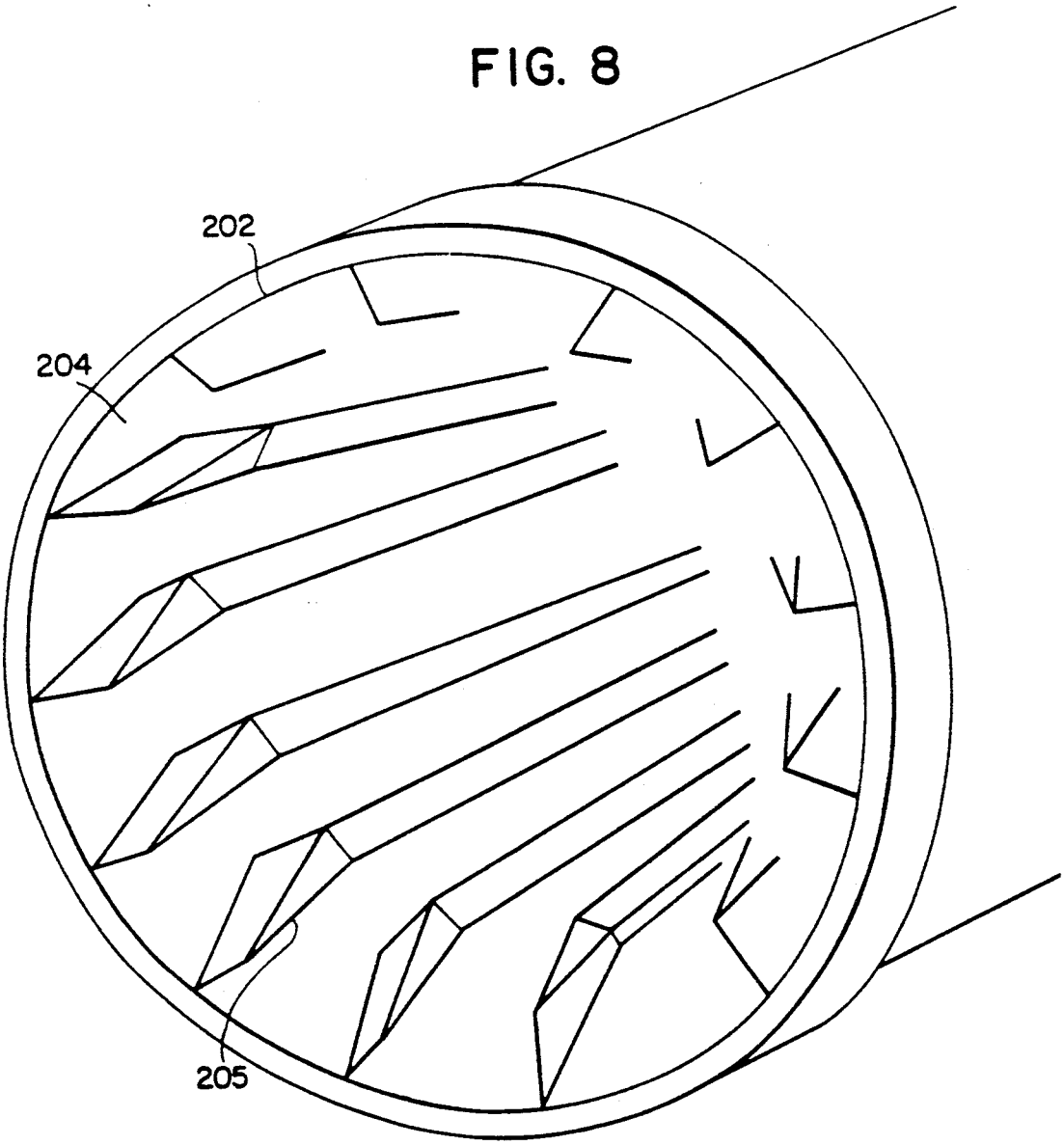
FIG. 8 is an perspective view of an end section of the feeder baffle section of the dryer assembly of FIG. 1.

As shown in FIG. 8, the feeder baffle section 204 is fitted with a plurality of paired infeed feeder vanes 205 which function to control the feed rate of materials to be dried to the inside of the baffle section 210. These paired vanes function to limit the amount of material fed into the baffle section 210 by cupping an optimal amount of material within the paired vanes 205 required for proper operation of the succeeding baffle sections. When material is fed into the dryer at a higher rate than the baffle section 210 can accommodate, the result is a back-up of materials in the paired feeder vanes 205, and the excess materials spill over the cup formed by the feeder vanes. When the flow rate of materials into the dryer decreases, the excess materials is again cupped by the feeder vanes and fed to the baffle section 210. This operation ensures that material volume is evenly distributed throughout the dryer, effecting a more uniform drying operation.

A system of the present invention can be adapted to condition different materials by varying the number of infeed baffles installed in a given drum radius. The number of baffles to be installed will depend on the moisture level of the materials being conditioned, the percentage of combustible elements in the materials, and the adhesion coefficient of the materials on the baffles 205. For example, inbound materials containing 83% moisture and having a small coefficient of adhesion would require 36 baffles, covering 1% of the dryer length, and materials containing 25% moisture and having a high coefficient of adhesion would require 20 baffles covering 10% of the dryer length. The size of the drum 202 can be varied in proportion to the volume of material that is to be conditioned in a given time period.

Figure 9:
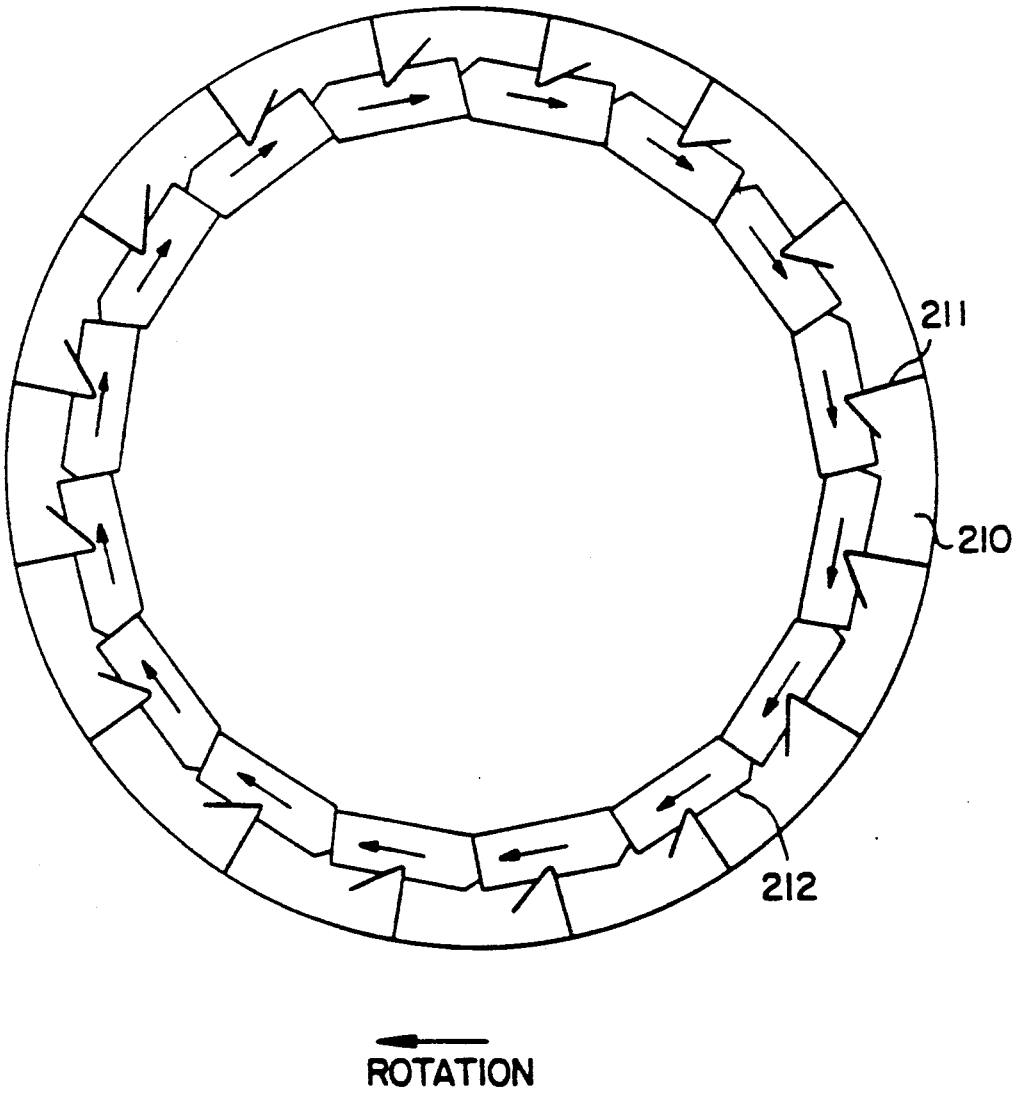
FIG. 9 is a sectional view taken along line a—a of FIG. 7.

Materials exiting the feeder baffle section 205 are conveyed into the baffle section 210 where they are preheated to a temperature at which efficient drying can be performed. The materials are preheated in this section by the combination of indirect heat transfer from the hot gasses and the heat from the surface area of the baffle sections. With reference to FIG. 9, the individual baffles of the section 210 are constructed with a cupping design 211 to enclose the materials and to protect them from the hot furnace gasses flowing through the center of the drum. This cupping action is necessary in light of the fact that the gasses entering the drum are generally hot enough to burn materials on contact. Such a premature combustion of the materials would create undesirable air-borne particulates. But the heat transfer which takes place within this section cools the gasses leaving the section to a point where they can contact the materials without effecting combustion.

These baffles 210 each have external feed accelerators 212 for rapidly transferring to the next section any materials that bypass the feeder baffle section or that cannot be accommodated by the cupping design due to a temporary overload condition. These accelerators 212 rapidly pass the materials to the downstream baffles without dropping them through the hot gasses.

The number of baffles in the baffle section 210 will be varied as a function of the heat transfer properties of the waste materials, the amount of combustibles in the materials, the amount of preheating needed to release water in succeeding dryer sections, the flow rate of material into the dryer assembly, and drum size, among other variables. For example, with the drum sized for an appropriate throughput, waste materials having a 25% moisture level and an ambient temperature of 75° F., would require 12 baffles and a preheat section of 18% of the dryer length.

As shown in FIG. 7, the materials exiting baffle section 210 next enter distribution baffle section 220, which functions to evenly distribute materials into the downstream baffle section 230. This section includes a plurality of lifter baffles designed to distribute the materials uniformly through the hot gasses and onto the heat transfer baffles 230. In FIG. 10, the lifter baffles 221, 222, 223, of each distribution baffle section 220 extend radially from the outer perimeter of the drum and are of three progressively increasing angles which release the materials at different points in a given rotation cycle of the drum 201. Air circulation within the drum then evenly distributes the materials into the next section 230 for heat transfer with the hot gasses, thereby ensuring a more uniform drying operation. The lifting and dropping action of these baffles 221, 222, 223 also functions to break apart any large clumps of material before they enter the first of the heat transfer sections 230.

The length of the baffle section 210 can be varied by changing the number of baffle sections placed in the distribution section. For example, materials having an inbound moisture level of 83% and a medium coefficient of adhesion would require a distribution baffle section covering 38% of the dryer length. Materials having an inbound moisture level of 83% and a low coefficient of adhesion would require a distribution baffle section covering 25% of the dryer length. It is desirable to vary the length of this section in dependence on material properties to provide optimum distribution of materials. For example, because a primary purpose of this section is to expose the materials to sufficient air flow to move them to the next section and to break up any aggregated product, the length of the distribution baffle section 210 will have to be increased as the density and/or the volume of material increases.

The materials exiting the distribution baffle section 220 in FIG. 7 are uniformly distributed onto the first baffle section of a primary drying section in which the materials are uniformly dried to the predetermined moisture level. The primary drying section includes a series of alternating heat transfer baffle sections 230 and recycle baffle sections 240. The last heat transfer baffle section 230 opens into the dryer drum exit 203 via velocity cone 250. The construction and function of one of each of the individual baffle sections 230 and 240 will be discussed in detail below.

The heat transfer baffle sections 230 are designed to provide uniform drying of materials. Each section includes a plurality of baffles specifically designed for high heat recovery from the hot gasses produced by the furnace. It should be noted that the hot gasses exiting the dryer assembly are properly categorized as vapors, since they have absorbed substantial amounts of moisture form the materials by the time they exit the last of the baffle sections.

Figure 12:
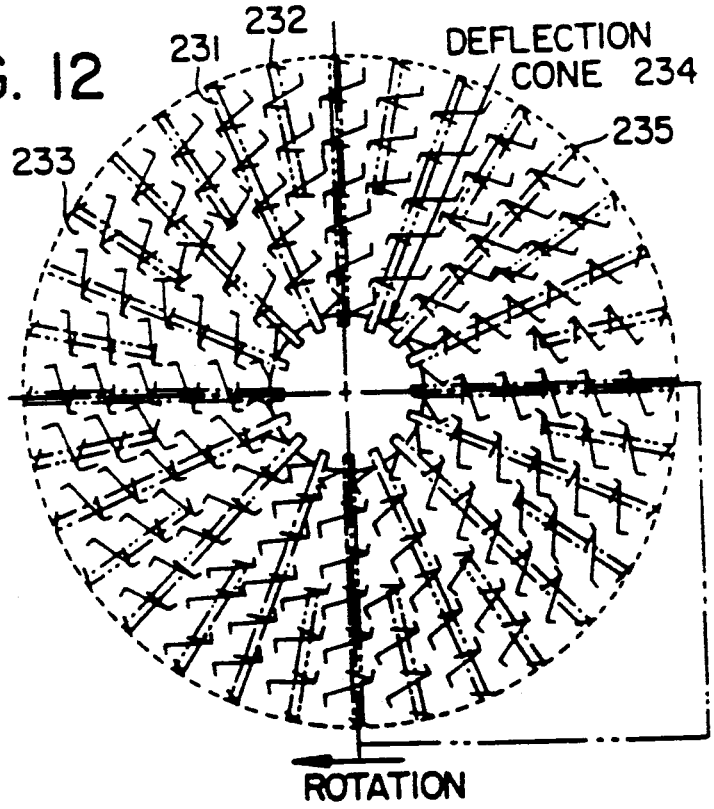
FIG. 12 is a sectional view taken along line d—d of FIG. 7.
Figure 13:
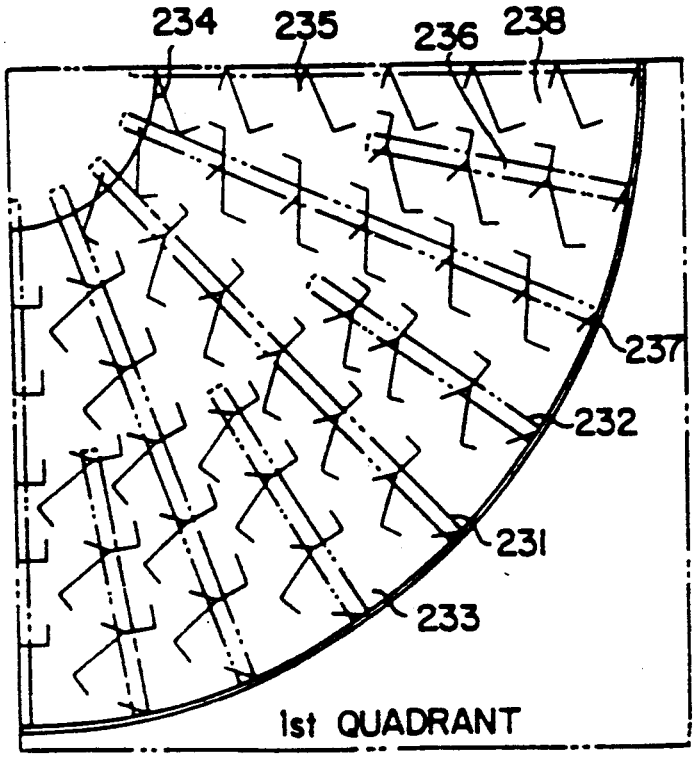
FIG. 13 is an enlarged view of a portion of FIG. 12.

As shown in FIGS. 12 and 13, each of these heat transfer baffle sections 230 comprise a plurality of alternating primary and secondary baffle support bars 231 and 232 extending radially inwardly from the outer perimeter of the drum and a plurality of polyhedral baffles 235 supported on each support bar. To maintain sufficient baffle surface to cross sectional areas at all portions of the drum diameter, the lengths of the secondary support bars 232 are approximately one half that of the primary support bars 231. Each of the support bars is attached on a flat bar backup plate 233. This backup plate also serves to suppress the flow of gasses through the dryer to maintain gas flow rates at the desired level. A deflector cone 234 is located at the center of the baffle section 230 to suppress further the flow of gasses through the dryer.

The support bars 231 and 232 form right angle baffles, and the polyhedral baffles 235 each have traps 236, 237 and 238, which extend at respective angles of 60, 70 and 90 degrees from the support bars on which they are attached. The traps 236, 37, and 238 enclose the materials so as to form miniature "drums" in which the material in each trap is independently dried via heat transferred from the metal surface of the traps of the material and also via direct transfer from the vapors to the material. Clearance between the individual traps of each polyhedral baffle 235 and the corresponding right-angle baffle formed by the corresponding support bar 231 or 232 is designed to retain materials in each baffle section 230 until they are light enough to be moved by the vapor stream. This section also functions to break apart any aggregations of materials to increase material quality and to improve heat exchange efficiency.

The length of the individual baffle sections 230 can be varied based on the amount of energy required to evaporate the moisture in the materials to the predetermined level. Factors which influence the required length of the respective baffle sections include the temperature of the materials entering the section, the amount of surface contact between the hot gasses and the material, the heat exchange coefficient of the materials, and the ability of the baffles to break apart the materials and the resulting surface area of the materials. The required length of these sections will also vary with the moisture content of the inbound materials, which will vary with dryer drum size.

Figure 14:
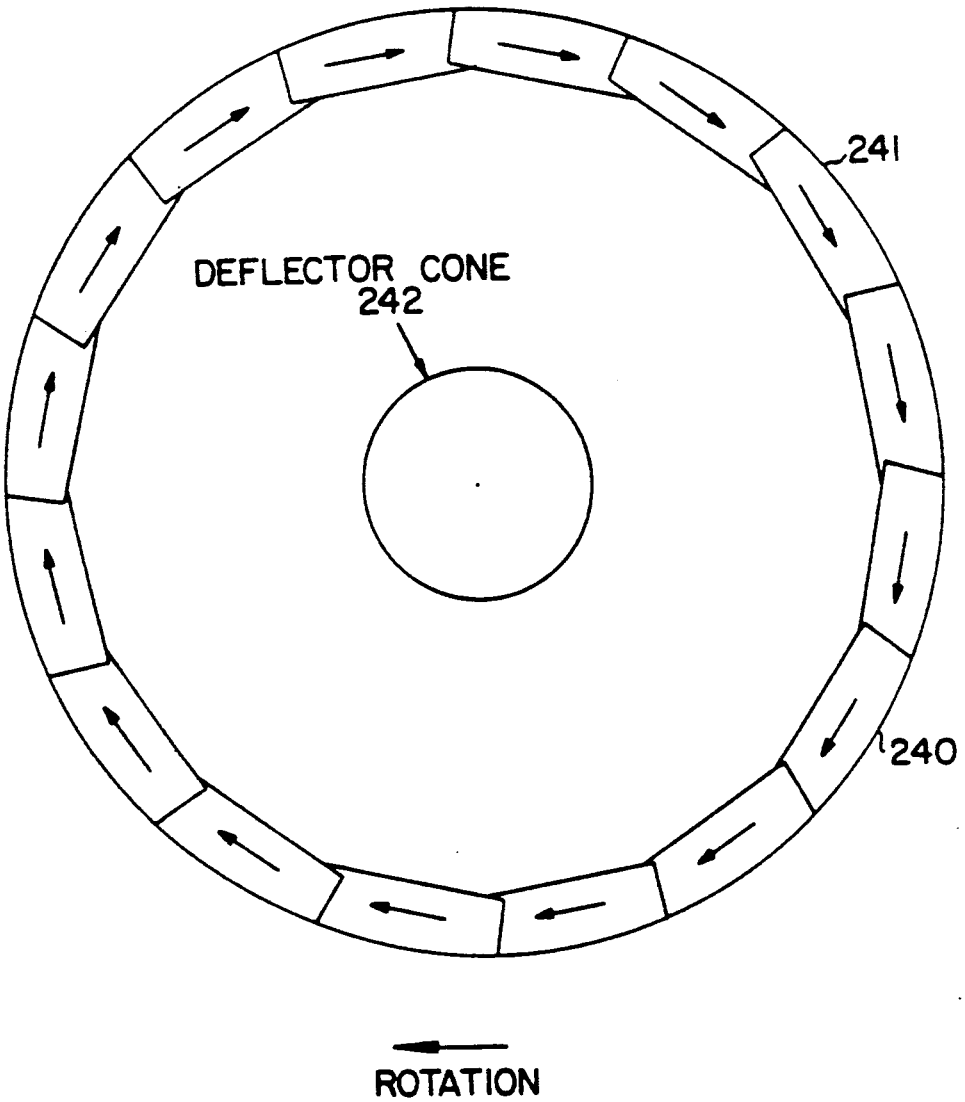
FIG. 14 is a sectional view taken along lines e—e of FIG. 7.

With reference again to FIG. 7, materials exiting the first of the heat transfer baffle sections 230 enter the first recycle baffle section 40. This baffle section 240 assures that the materials are uniformly dried by injecting high density materials, which are not yet dry enough to be conveyed by the gas flow, back into the first heat transfer baffle section 230 for further drying. The recycle baffle section 240 comprises a plurality of inverted return or back-step baffles, one of which is shown in FIG. 14. Each of these baffles comprise a 180 degree cup 241 on the dryer centerline side of the baffle section 240 to hold the materials during drum rotation and to shield the flow of materials which are being recycled from the dryer gas stream. The cup 241 is also tapered at a 30 degree angle to provide reverse acceleration of materials back into the first heat transfer baffle section 230. A deflector cone 242 is located at the center of the baffle section 240 to maintain gas flow rates at the desired level.

The angle of attack of the inverted baffles for each section 240 and their distance from the outer drum shell of each recycle baffle section 240 are matched to drum rotation velocity and material specific gravity. These variables determine the amount of reverse flow of materials that is required and, thus select the moisture content of the materials which leave the baffle section 240. The length of the individual baffle sections 240 can be varied in dependence on the size of the dryer drum, which, as previously mentioned, varies with the volume of material to be conditioned.

The materials continue to travel from section to section where they are progressively dried until they reach the velocity cone 250, located at the center of the exit 203 of the drum 201, which controls the flow rate of exiting materials and insures that only dried materials exit the dryer assembly. The velocity cone 250 has a 5 to 1 base to altitude ratio to reduce the air velocity through the open cone section, thereby controlling the flow rate of the dry materials. It also deflects any small sized particles that are being carried by the vapor stream back into the heat transfer baffle section 230. This ensures that material exiting the dryer assembly is carried by the vapor flow by virtue of its low specific gravity, brought about by a low moisture content, rather than simply its small particle size. The velocity cone 250 thus provides a final assurance that all of the materials exiting the dryer assembly 200 have reached the predetermined moisture level.

By changing the numbers of alternating heat transfer baffle sections 230 and recycle baffle sections 240, the dryer 200 can be readily modified to dry a variety of materials to different moisture levels. In addition, the amount of preheating performed in baffle section 210 and material distribution performed in section 220 is modifiable simply by changing the number of baffle sections 210 and 220. In addition, the individual baffle sections can be replaced by sections specifically designed for a given application, the design considerations for which were discussed above. A given dryer assembly thus can be quickly and easily modified to perform a wide variety of drying and conditioning operations.

In FIG. 2–5, dried materials exiting dryer 200 are conveyed to furnace 100 via a conveyor 315, where they are incinerated as discussed above. The conveyor also communicates with the fan assembly 300, which withdraws the vapors from the dryer and clarifies and recycles the vapors.

Both the hot gasses used to dry the waste material and the particulate emissions from the dryer discharge stack preferably satisfy applicable air quality regulations relating to federal air regulation standards. Accordingly, recycling/separating fans shown generally at 300 (see FIGS. 3, 4 and 17–20) are attached to an outlet duct 290 of the dryer assembly 200. These fans are multi-purpose in that they draw hot, moisture-laden vapor through the dryer assembly, separate the particulate contamination from this vapor stream, and pump the cleaned, recycled vapor stream back to the VGC burner via dryer exhaust conduit 105 and recycle conduit 106 (FIG. 5). Although various types of dust control/fan systems can accomplish the recycling/separating function a preferred dust control system is used which accelerates incoming vapor streams to centrifugally separate particulate matter from the vapor stream. Because the fans are operating at the same temperature as the dryer exhaust vapor, there is no condensation and no accumulation of water vapor. The fans thus assure that vapor entering exhaust stack 107 (FIGS. 2 and 3) is free of condensed water.

Figure 16:
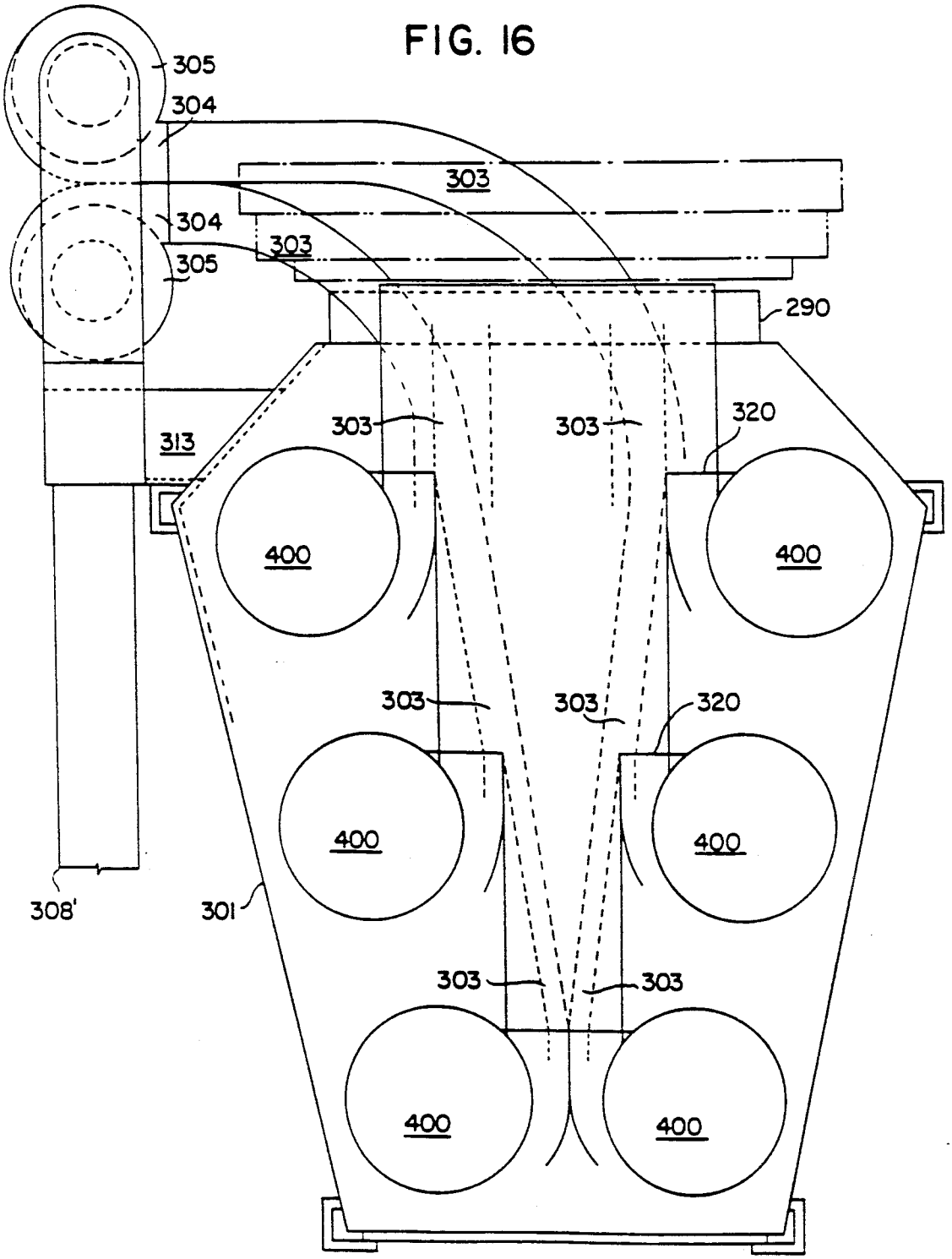
FIG. 16 is a top view of the fan assembly of FIG. 15.
Figure 17:
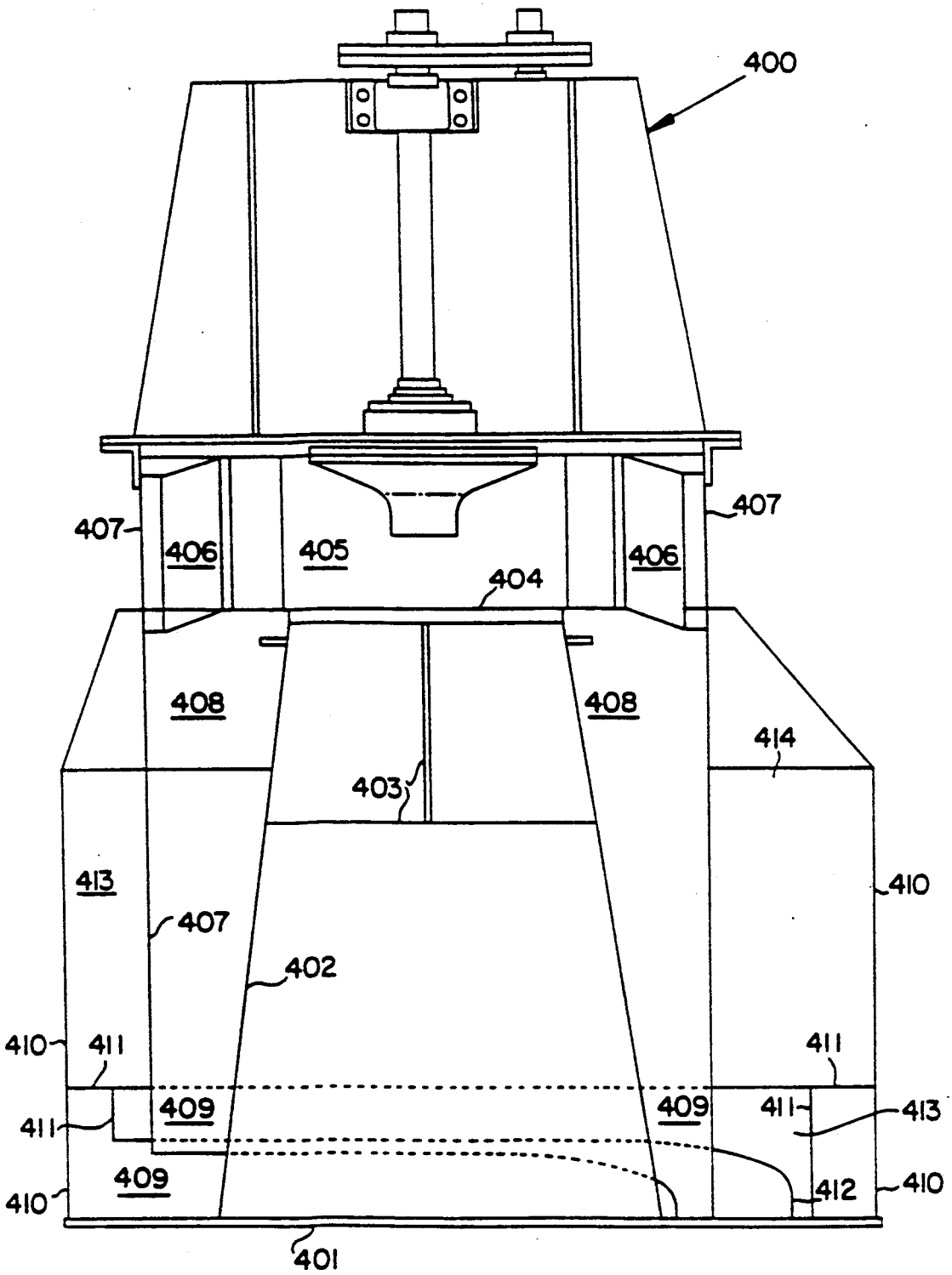
FIG. 17 is a sectional side view of a fan used in connection with the present invention.

As shown in FIGS. 16 and 17, suction box 301 is the focal point of the dust control system. The Magnum Fans 400 are located in the roof of the suction box 301 (see FIG. 16). The number of fans is determined by the drying capacity of the dryer. A detailed description of the fan structure will follow. The hot vapors withdrawn from the dryer are subjected to a two-tier clarification process before being recycled.

Figure 15:
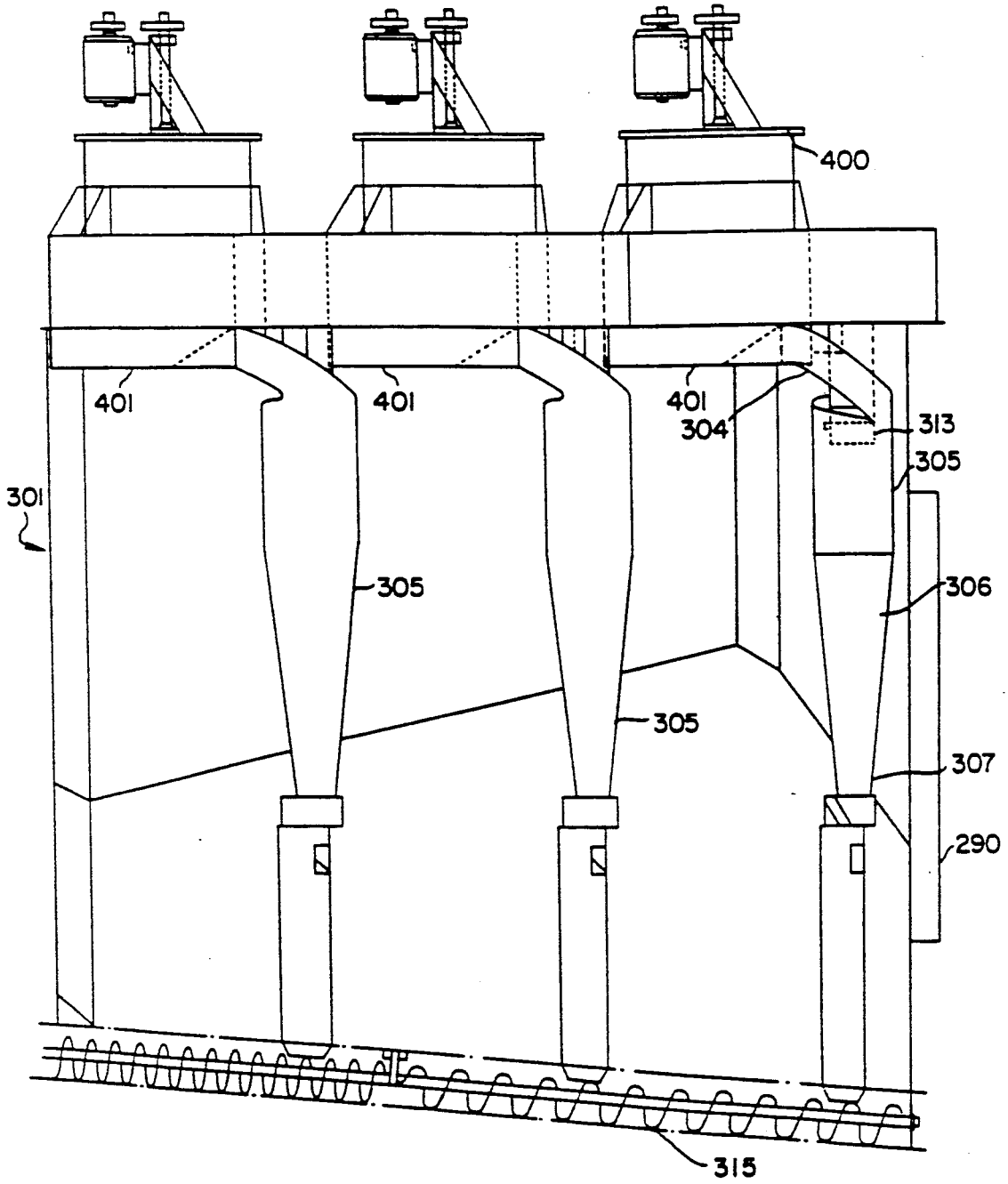
FIG. 15 is a sectional view of a portion of a fan assembly taken along the line 15—15 in FIG. 3.

As shown in FIGS. 15–17, each of the Magnum Fans 400 is situated on top of suction box 301 to allow the suction box to lower the velocity of the vapor so that heavier material in the dryer drum falls out of the vapor stream, to be removed by primary evacuating auger 315 (see FIG. 3). Each fan 400 includes a conical shaped inlet portion 401 which tapers towards the outlet thereof which communicates with impeller inlet 404. The conical shape of this inlet portion 401 increases the velocity of the incoming vapor stream to a level sufficient to centrifugally remove heavier particulate matter from the stream while preventing the collection of particulate matter on the sides or bottom of the inlet portion 401.

The suction box 301 is designed for supporting the load of the fans 400, to support and enclose primary cyclones 305, and to support exterior secondary cyclones 305'. The secondary cyclones 305' are used in systems that require more stream clarification than can be achieved by the interior primary cyclones 305. By enclosing the primary cyclones 305 within the suction box 301, the temperature of the vapor entering the cyclones remains hot, thereby preventing a temperature differential that would lead to condensation. Such condensation is undesirable, as particulate matter in the vapor stream would adhere to the condensed moisture on the internal surfaces of the system. This particulate matter would at least partially block the internal ducts of the system, thus reducing its operational efficiency. The amount of condensation in the secondary cyclones 305' is also reduced by placing the fans on top of the suction box 301 which ensures that the vapor stream entering cyclones 305' from fans 400 is of a relatively high temperature. The structure and operation of the fan assembly and suction box, including the cyclones, will now be described with reference to FIGS. 15–20.

First, as illustrated by FIG. 16, the internal dust collection system of the suction box accelerates the vapor withdrawn from the dryer assembly and separates the vapor into a primary stream of clarified media and a secondary stream, the latter containing a high concentration of particulate matter. The primary stream which contains the clarified vapor is conveyed out of the fan to conduits 105 and 106. The secondary stream is discharged into conduit 303. Conduit 303 serves as a common manifold and leads to the entrance 304 of high-efficiency cyclone collectors 305. The number of cyclone collectors in each system can be varied in accordance with the type of waste material being processed. The suction box 301 includes louvers 320, located on top of the suction box adjacent the fans, which control the velocity of the vapor stream, to cause fall-out of the large sized waste particulates removed from the dryer drum. These louvers are designed based on the consistency of the material being processed. The angle and coverage of the louvers will be changed to match material specifications.

Cyclones 305 and 305' further clarify the entering secondary stream by decelerating the secondary stream and causing the remaining particulate matter to fall to the lower portion 306 of the cyclones (FIG. 15). As seen in FIG. 15, the fallen particulate matter then exits the cyclones 305 at point 307 and enters a common auger conveyor 308. To maintain an effective a seal at cyclone exit 307 into conveyor 308, the auger employs a full pitch auger 309. Without the seal on the bottom of the auger, some of the inbound vapor is lost through the bottom of the cyclone. Such a loss of vapor would result in a reduced volume, and thus a reduced velocity, of vapor in the cyclone, lowering the efficiency of the particulate removal operation. Thus, auger speed is regulated to maintain a particulate control level 311 in the up stream cyclone exit 307. Outside air is prevented from entering the negative pressure in the system by a positive seal created by the particulate matter itself and controlled by the speed of auger 309.

The clarified secondary stream now returns to the suction box 301 via conduit 313 (FIGS. 15 and 16). Any particulate matter remaining in the secondary stream is immediately recycled through the fans 400 from the interior of suction box 301 and is where the above noted dust collecting cycle is repeated. The clarified secondary stream is then discharged from the fan assembly 300 and is conveyed to the front of the dryer assembly 200 via conduits 105 and 106. If desired, a portion of the vapors removed by fan assembly 300 can be supplied to the waste heat evaporator 6 via stack 107 (FIG. 1*b*–3) to perform the evaporation and scrubber operation.

Figure 18:
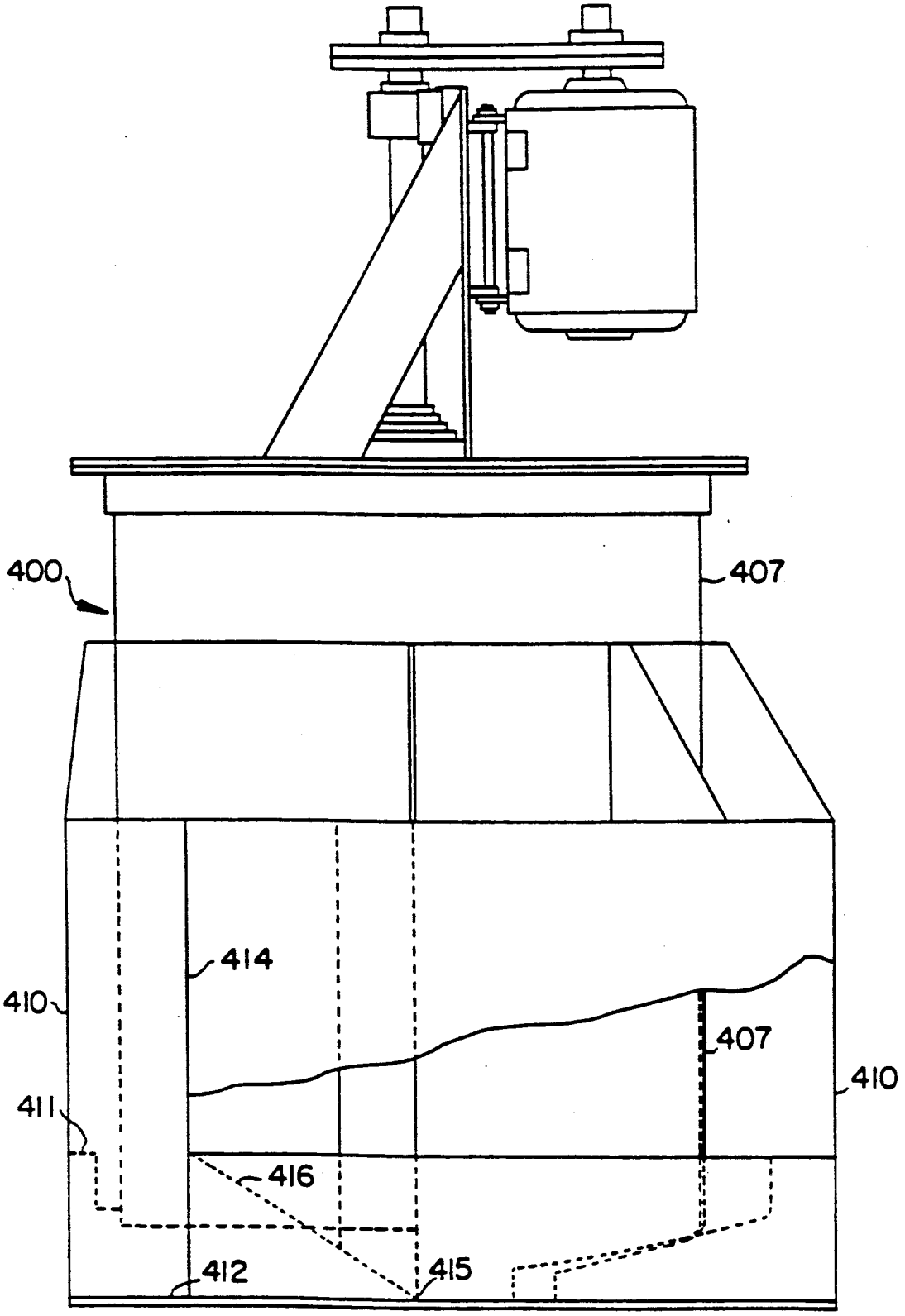
FIG. 18 is a side view of the fan of FIG. 17.
Figure 19:
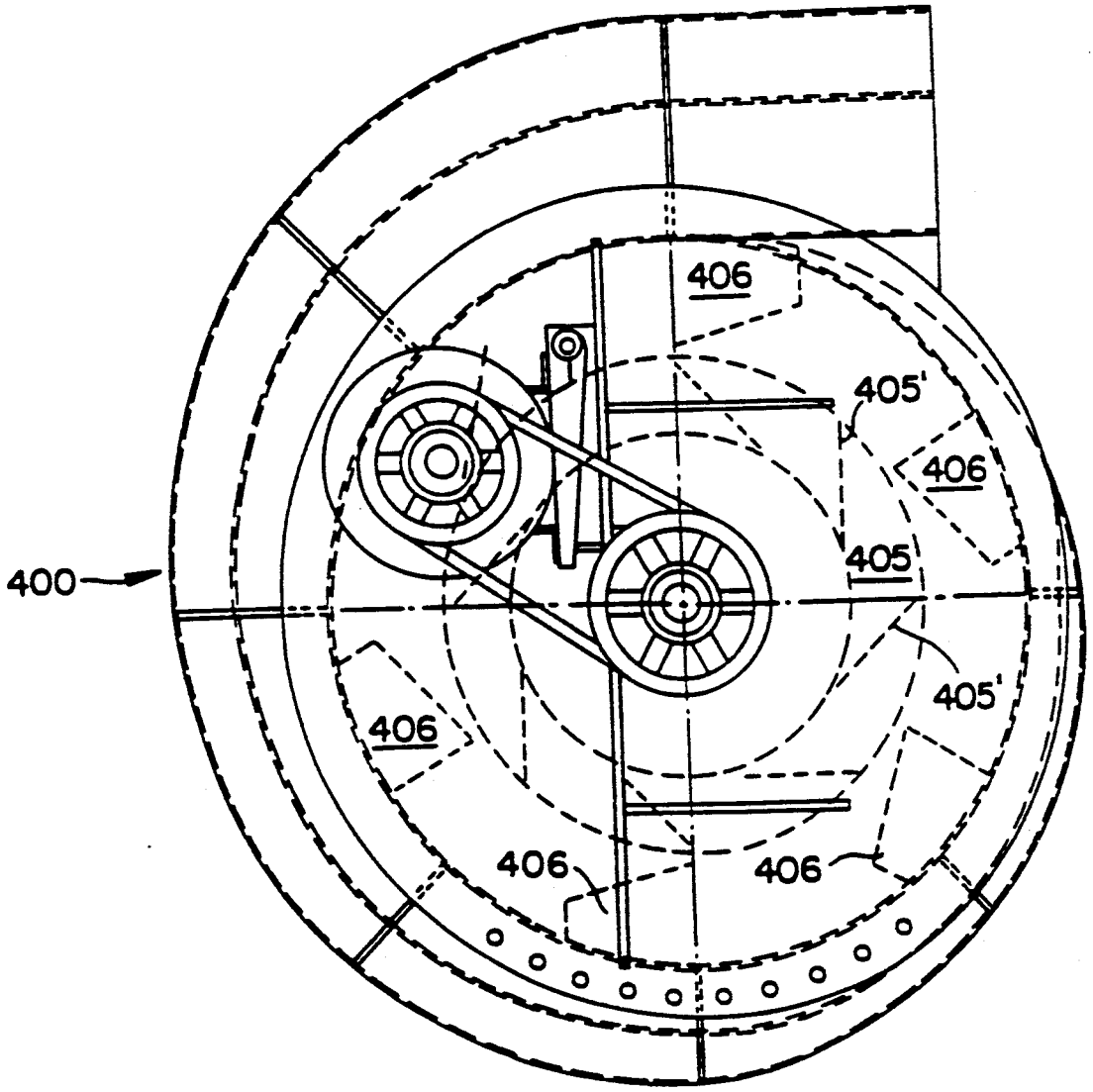
FIG. 19 is a top view of the fan of FIG. 17.

A more detailed description of the internal dust collection system of the fans 400 follows. As shown in FIG. 17, vapor heavily laden with particulate matter is drawn into the fan entry 401 and conveyed in a converging nozzle 402 toward a Vortex breaker baffle 403 at the impeller inlet 404. As seen in FIGS. 17–19, an impeller 405 has several inclined blades 405' which extend away from the direction of rotation of the fan at an angle of 30 degrees from the exterior circumference of the fan. The impeller 405 imparts axial energy to the vapor and particulate matter, directing the vapor and particulate matter to enter a series of accelerating chambers 406, mounted at about a 60° angle around the inside perimeter of the fan casing 407. The chambers 406 accelerate the vapor through a downwardly spiralling (centrifugal) motion. The vapor then leaves the accelerating chamber and enters separating chambers 408 (FIG. 17). The particulate matter is thus accelerated in chambers 406 and is then separated from the vapor by adhering to the inner fan casing wall 407. The downward spiraling vortex motion (centrifugal motion) thus produced by the chambers 406 conveys the vapor and particulate matter, now highly separated, through the separating chamber 408 and into the concentrating area 409. The concentrating area formed by the inner fan casing wall 407 and the converging cone 402 acts to re-accelerate the concentrated vapor and particulate matter. This re-acceleration ensures that the particulate matter will have sufficient momentum to impact tangentially against an inner scroll casing wall 410 of the from 400 suction box 301. The inner and lower portion of the scroll wall form a conduit with a directing vane 411 attached to the scroll wall 407. The directing vane 11 has a vertical leg which traps particulate matter in the conduit formed by the scroll wall 410 and vane 411. The conduit conveys particulate matter to the particulate exit 412.

The directing vane 411 also forms an annulus with fan casing 407. This annulus allows the clarified vapor to enter passageway 413. Passageway 13 becomes a conduit formed by scroll casing 410 and fan casing 407 whereby clarified vapor is conveyed to the fan clarified vapor exit 414.

The funnel for the particulate matter exit 412 begins at point 415 and ends at the exit 412. Point 415 is also the beginning of the inclined transition plate 416 that directs clarified vapor to the fan clarified vapor exit 414.

What is claimed is:

1. A dryer assembly for uniformly drying moisture-laden material, said dryer assembly comprising:

(A) an inlet portion communicating with a source of hot gas and a source of said material;

(B) an outlet located remote from said inlet portion;

(C) conveying means for conveying said material from said inlet portion to said outlet, said conveying means comprising (i) preheating means, located within said inlet portion, for heating said material within a space where said gasses are present but do not contact said material, such that combustion of said material is avoided while the temperature of said gasses is decreased, said preheating means comprising a plurality of baffles being constructed with a cupping design which encloses the material and protects it from said hot gasses, and (ii) mixing means, located in a mixing portion situation between said preheating means and said outlet, for mixing said material with said gasses to dry said material uniformly to a predetermined moisture level via direct contact with said gasses and via direct contact with said mixing means.

2. The assembly of claim 1, wherein said mixing means comprises a drum-type conveyor presenting a plurality of baffles which are adapted to mix said material while conveying said material within said dryer means.

3. The assembly of claim 2, wherein said conveying means further comprises a plurality of baffles, located within said inlet portion, each of which comprises paired feeder vanes which are adapted to control the feed rate of material into said mixing portion.

4. The assembly of claim 1, wherein said baffles are located within said inlet portion and are each constructed with external feed accelerators adapted to rapidly transfer a portion of said material into said mixing portion.

5. The assembly of claim 2, wherein a plurality of said baffles, located within said mixing portion, comprises lifter baffles of varying angles which are adapted to grasp said material and to release different portions thereof at different points in a given rotation cycle of said drum, thereby uniformly distributing said material into a succeeding baffle section.

6. The assembly of claim 2, wherein a plurality of said baffles form a series of alternating first and second baffle sections defining a primary drying section where said material is uniformly dried to said predetermined level.

7. The assembly of claim 2, wherein each of a plurality of said baffles comprises (a) support bars extending radially inwardly from the perimeter of said drum and (b) polyhedral baffles supported on each of said support bars.

8. The assembly of claim 7, wherein each polyhedral baffle comprises angled members defining traps which extend at angles from the support bar and which are adapted to retain and mix material.

9. The assembly of claim 6, wherein each of said second baffle sections comprises baffles having cup members adapted to recycle within said primary drying section a part of said material that has not yet been dried to a predetermined moisture level, thereby further to dry said part.

10. The assembly of claim 2, wherein the diameter of said drum-type conveyor is designed to meet the needs of a particular material.

11. The assembly of claim 1, wherein said hot gasses and said materials are both discharged from said dryer via said outlet, and wherein said hot gasses provide means for conveying said materials out of said outlet.

* * * * *